US007367522B2

(12) United States Patent
Chen

(10) Patent No.: US 7,367,522 B2
(45) Date of Patent: May 6, 2008

(54) STRING FASTENING DEVICE

(76) Inventor: Chin Chu Chen, No. 11, Lane 188, Gungye Rd. Lung Ching Hsiang, Taichung Hsien (TW)

( * ) Notice: Subject to any disclaimer, the term of this patent is extended or adjusted under 35 U.S.C. 154(b) by 407 days.

(21) Appl. No.: 11/249,487

(22) Filed: Oct. 14, 2005

(65) Prior Publication Data

US 2007/0084956 A1 Apr. 19, 2007

(51) Int. Cl.
*B65H 75/48* (2006.01)
*A43C 11/00* (2006.01)

(52) U.S. Cl. ..... 242/378.1; 24/68 SK

(58) Field of Classification Search ..... 242/378, 242/378.1–378.3, 388, 388.1–388.3; 36/50.5; 24/68 SK See application file for complete search history.

(56) References Cited

U.S. PATENT DOCUMENTS 4,633,599 A * 1/1987 Morell et al. ..... 242/388.1
4,660,300 A * 4/1987 Morell et al. ..... 36/118.1
5,157,813 A * 10/1992 Carroll ..... 24/68 SK
5,178,619 A * 1/1993 Galazaka ..... 606/41
5,325,613 A * 7/1994 Sussmann ..... 36/50.1
5,934,599 A * 8/1999 Hammerslag ..... 242/396.1
6,289,558 B1 * 9/2001 Hammerslag ..... 24/68 SK
6,694,643 B1 * 2/2004 Hsu ..... 36/50.1
7,076,843 B2 * 7/2006 Sakabayashi ..... 24/68 SK

* cited by examiner

*Primary Examiner*—Peter M. Cuomo
*Assistant Examiner*—Sang Kim
(74) *Attorney, Agent, or Firm*—Bacon & Thomas, PLLC.

(57) ABSTRACT

A string fastening device includes a reel on which a string is reeled thereon and a toothed ring is connected to the reel. A knob has a shaft inserted into a tube extending from the base of the device and the reel is rotatably mounted on the tube. The knob has first teeth in an underside thereof and the first teeth are engaged with the toothed ring so that the reel is driven by rotation of the knob to tighten the ring. The knob can be pulled away from the reel to disengage the first teeth from the toothed ring so that the string can be loosened. The knob includes second teeth and the base has two pawls which limit the knob to rotate in one direction to drive the reel.

8 Claims, 10 Drawing Sheets

STRING FASTENING DEVICE

FIELD OF THE INVENTION

The present invention relates to a fastening device with a clutch device which controls the knob to be rotate in one direction to fasten the string.

BACKGROUND OF THE INVENTION

A conventional fastening device for tighten a string or shoe lace is shown in FIGS. 8 and 9 and generally includes a case 60 composed of a base 61 and a cover 62 between which a space 63 is defined and a ratchet device, a gear set 70 and a reel 80 are received in the space 63. A shaft 64 extends through the case 60, the ratchet device, the gear set 70 and the reel 80, and is connected to a knob 65 which is rotated relative to the case 60 so as to rotate the ratchet device which drives the gear set 70 and the reel 80. Two ends of a string 81 are fixed on the reel 80 and the string 81 is reeled around the reel 80. The ratchet device includes a ratchet wheel 71 and a pawl 66 is pivotably connected to the cover 62 and is cooperated with a torsion spring 661 so that the pawl 66 is normally biased by the torsion spring 661 toward the ratchet wheel 71. The ratchet wheel 71 has ratchet teeth which are shaped so that the ratchet wheel 71 is allowed to rotate counter clockwise and cannot rotate clockwise because of the pawl 66. The pawl 66 includes a protrusion 662 extending from an end thereof and a shifting lever 67 pivotably or movably connected to the cover 62, the shifting lever 67 includes a pushing end 671 which pushes the protrusion 662 away from the ratchet wheel 71 by operating the shifting lever 67 exposed on an outside of the cover 62. When the user rotates the knob 65 counter clockwise, the gear set 70 is driven by the ratchet wheel 71 and the reel 80 is rotated at higher speed because of the ratio of the gear set 70 so that the string 81 is securely reeled on the reel 80 and the object that the string 81 ties is secured. When shifting the shifting lever 67, the pawl 66 is pivoted and away from the ratchet wheel 71. The string 81 is then able to be loosened manually.

However, there are too many parts in the fastening device which has a limited space to receive all the parts, so that it is difficult and takes a lot of time to assemble the fastening device. Besides, the exposed shifting lever might tangle foreign objects, especially when the fastening device is installed on shoes.

The present invention intends to provide a fastening device that includes a clutch device which is activated simply by operating the knob upward or downward, and the knob is positioned in each of the two positions.

SUMMARY OF THE INVENTION

The present invention relates to a string fastening device which comprises a base with a tubular wall and a tube extends from a top of the base and is located in a space enclosed by the tubular wall. A connection flange extends inward from an inner periphery of the tubular wall and two pawls are axially movably inserted into a top of the connection flange. Each pawl has an inclined top surface. A reel is rotatably mounted on the tube and the reel has a toothed ring connected on a top thereof. A positioning ring is fixedly connected on the connection flange to limit the reel to move in axial direction. Two notches are defined in an outer periphery of the positioning ring and the two pawls extend through the notches. A knob has a shaft extending from an underside thereof and the shaft is movably inserted into an axial passage of the tube. A skirt portion extends from the underside of the knob and the shaft is located at a center in a space enclosed by the skirt portion. A plurality of first teeth are defined in an inner periphery of the skirt portion and engaged with the toothed ring on the reel. A plurality of second teeth are defined in the underside of the knob and engaged with the inclined surfaces of the pawls such that the knob is rotated in one direction and stopped in the other direction by the pawls. The second teeth are disengaged from the pawls when the knob is pulled upward. A string has two ends extending through the tubular wall and are secured to the reel. The string is reeled on the reel.

The primary object of the present invention is to provide a string fastening device that includes a knob which can be pulled upward to disengage the knob from the reel so that the string can be loosened.

Another object of the present invention is to provide a string fastening device wherein no gear set is required and no shifting lever is protruded from outside of the device.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 2-1 is a top view of the string fastening device of the present invention;

DETAILED DESCRIPTION OF THE PREFERRED EMBODIMENT

Figure 1:
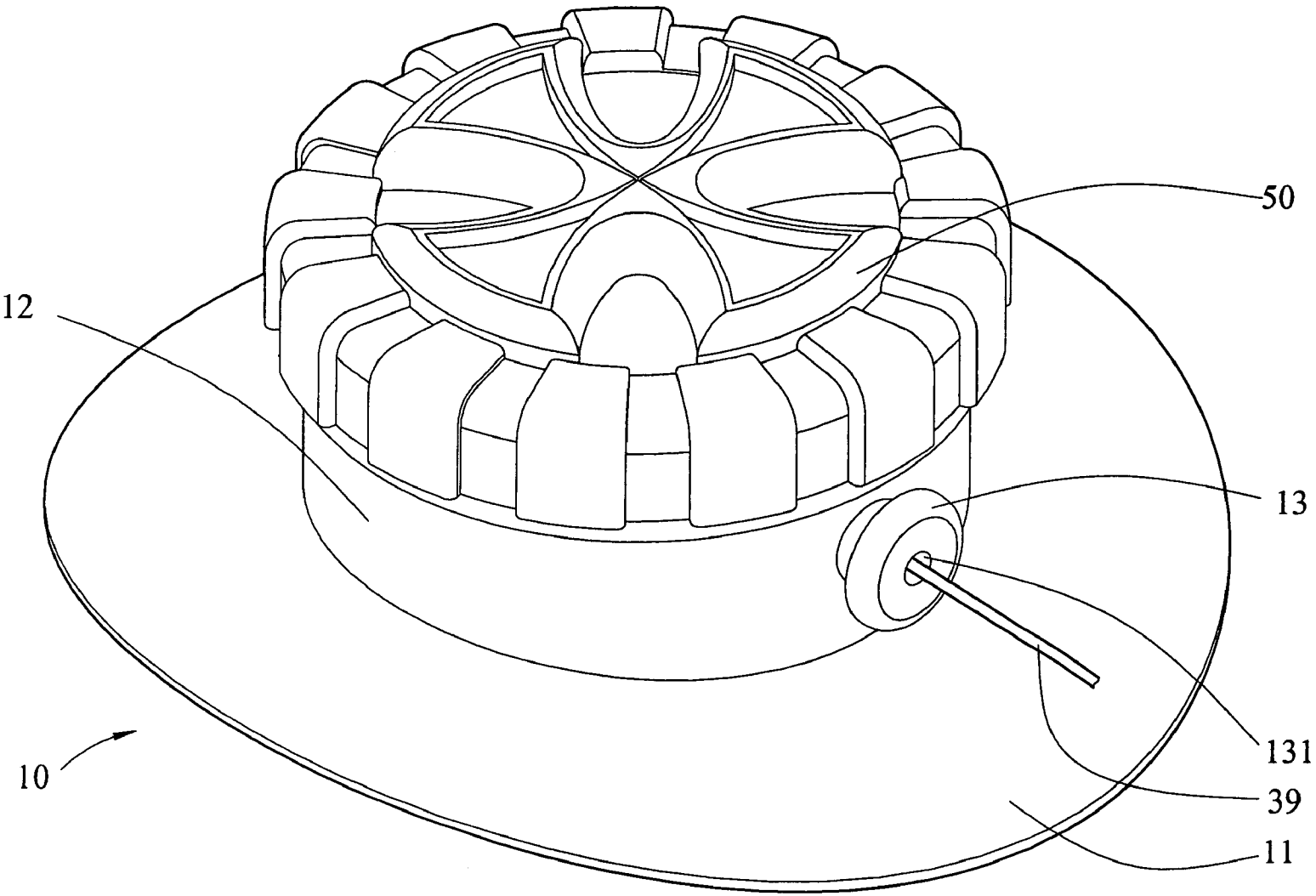
FIG. 1 is a perspective view to show the string fastening device of the present invention.
Figure 2:
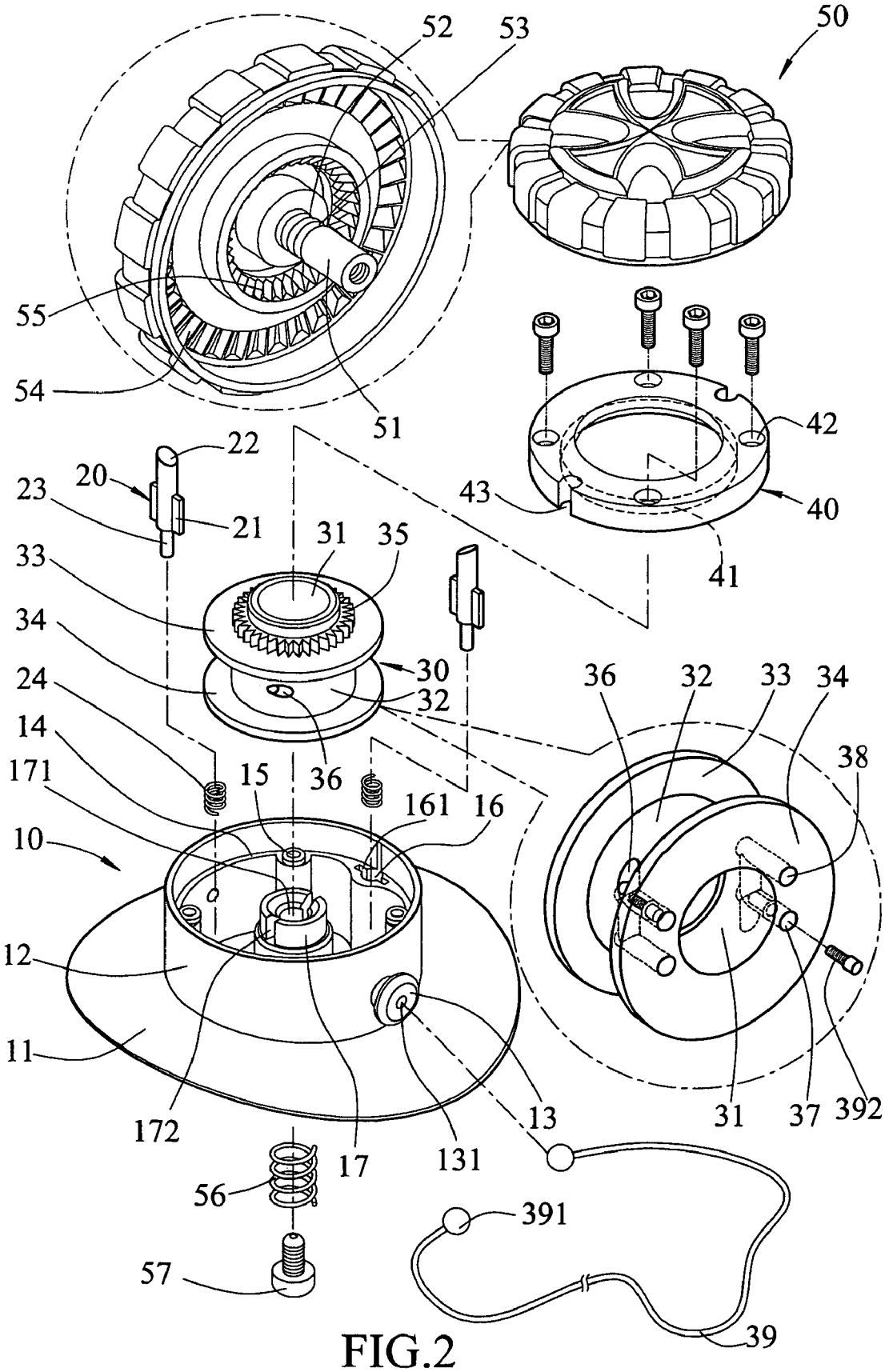
FIG. 2 is an exploded view to show the string fastening device of the present invention.
Figures 1, 2:
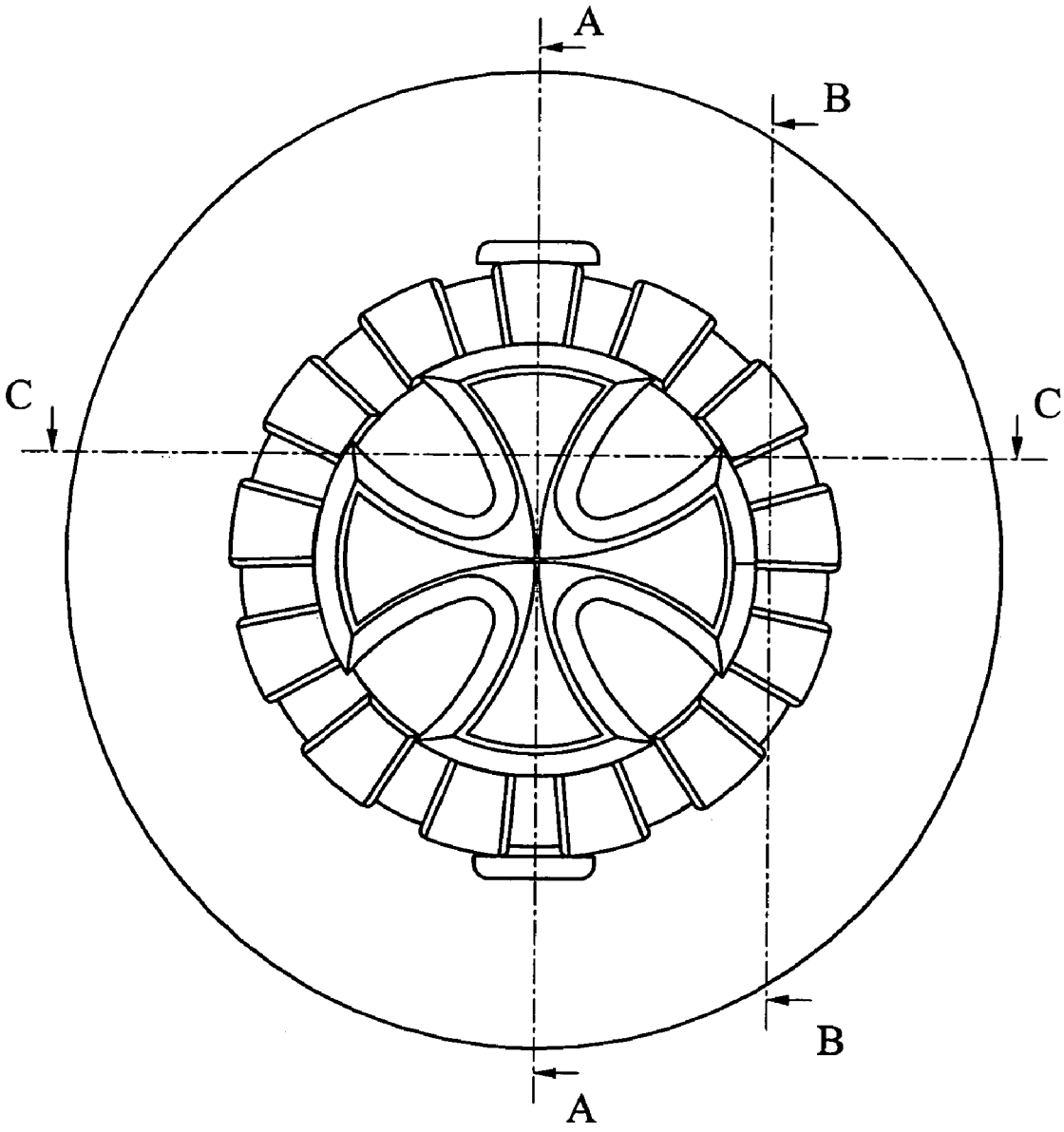
Figure 3:
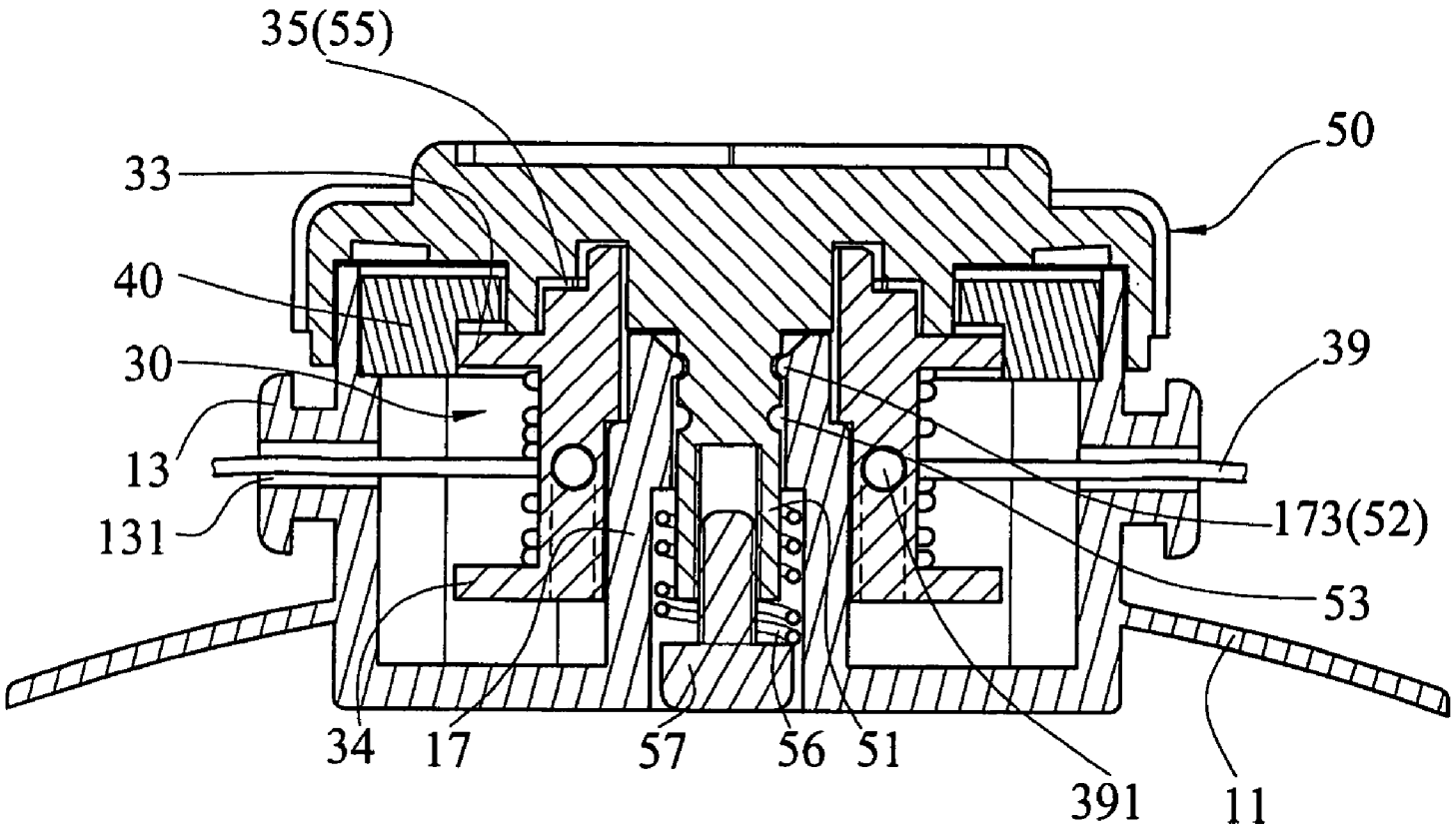
FIG. 3 is a cross sectional view taken along the cutting line A-A in FIG. 2-1.
Figure 4:
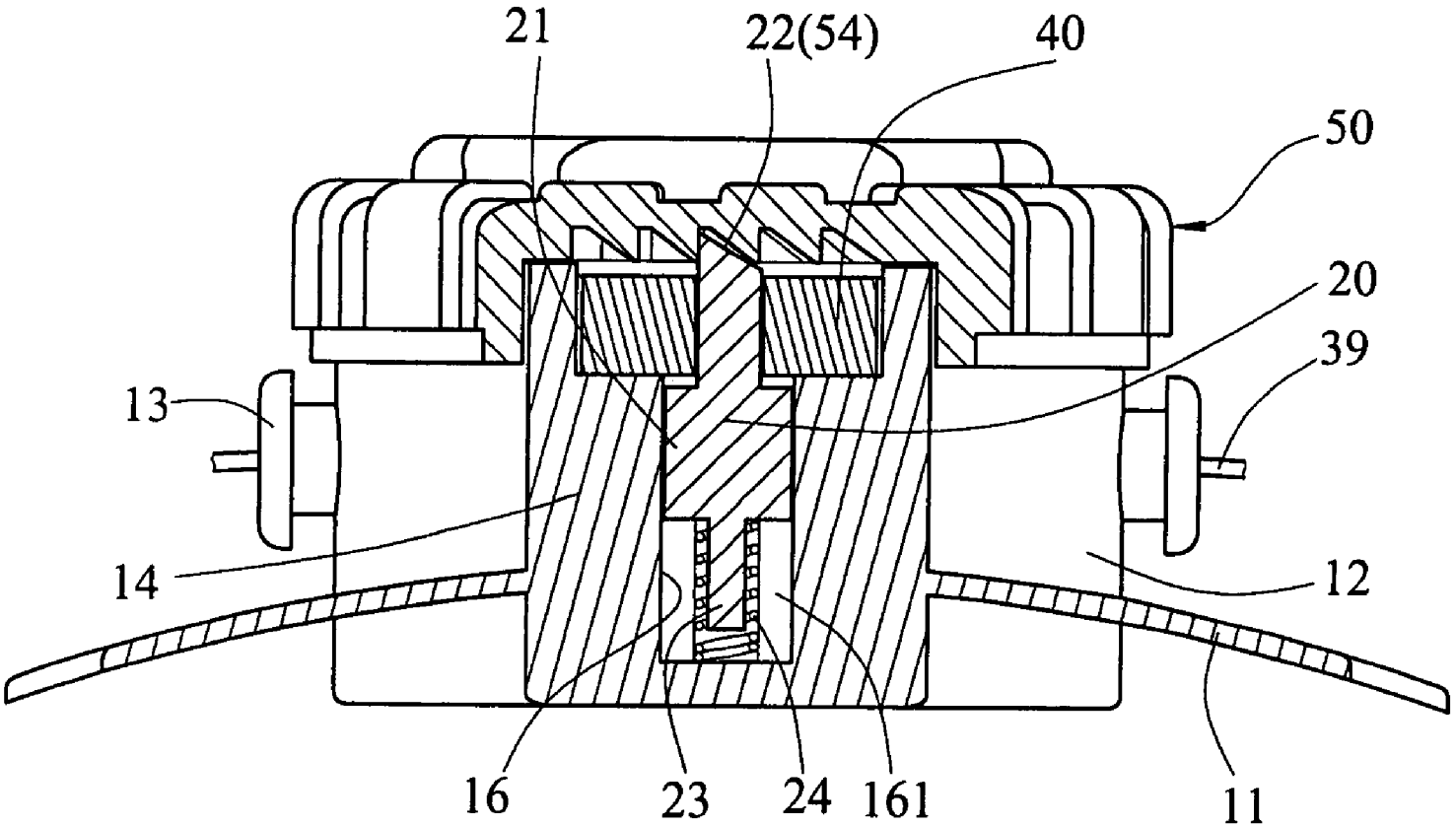
FIG. 4 is a cross sectional view taken along the cutting line B-B in FIG. 2-1.

Referring to FIGS. 1, 2, 2-1, 3 and 4, the string fastening device 10 of the present invention comprises a base 11 with a tubular wall 12 on a top thereof and two protrusions 13 extend radially outward from the tubular wall 12 and each protrusion 13 has a hole 131 defined therethrough. A tube 17 extends from the top of the base 11 and is located in a space enclosed by the tubular wall 12. The tube 17 includes two slots 172 which open to a top of the tube 17 so as to form two parts on the top of the tube 17, and the two parts can be expandable outward and inward. A connection flange 14 extends inward from an inner periphery of the tubular wall 12 and a plurality of threaded holes 15 and two receiving holes 16 are defined in a top of the connection flange 14. The two receiving holes 16 each have two slits 161 which are in communication with the receiving hole 16 corresponding thereto. Two pawls 20 each have an insertion 23 on a lower end thereof which is axially movably inserted into the receiving hole 16 corresponding thereto and a spring 24 is mounted onto each of the two insertions 23. Each pawl 20 further has an inclined top surface 22. Two wings 21 extend in two opposite direction from an outer periphery of each pawl 20 and the two wings 21 of each pawl 20 are movably inserted into the slits 161 so that the pawls 20 cannot rotated relative to the connection flange 14.

A reel 30 includes a tubular body 32 with a central hole 31 and a first flange 33 extends from a first end of the tubular body 32 and a second flange 34 extends from a second end of the tubular body 32. The reel 30 is rotatably mounted to the tube 17 which extends through the central hole 31. A string 39 having two ends extending through the two holes 131 in the tubular wall 12 and secured to the reel 30, the string 39 reeled on the reel 30. The tubular body 32 includes two apertures 36 defined through a wall thereof and two first passages 37 and two second passages 38 are defined axially from an underside of the second flange 34 and perpendicularly communicate with the two apertures 36 respectively. The two ends of the string 39 extend through the holes 131 in the two protrusions 13 on the tubular wall 12, then through the apertures 36 in the reel 30. The two ends are extended out from the second passages 38. Two beads 391 are then connected with the two ends of the string 39 and the string 39 is then pulled back so that the two beads 391 are engaged with the second passages 38. Two bolts 392 are threadedly connected to the first passages 37 and contact against the strings 39 such that the string 39 is securely connected to the reel 30. The reel 30 further has a toothed ring 35 connected on a top of the reel 30.

A positioning ring 40 has a plurality of holes 42 defined therethrough and the connection flange 14 and bolts extend through the holes 42 in the positioning ring 40 and are threadedly connected to the threaded holes 15 to fix the positioning ring 40 on the connection flange 14. The positioning ring 40 further has an annular recess 41 defined in an underside thereof and the first flange 33 of the reel 30 is engaged with the annular recess 41 so as to limit the reel 30 to move in the axial direction. Two notches 43 are defined in an outer periphery of the positioning ring 40 and the two pawls 20 extend through the notches 43.

A knob 50 has a shaft 51 extending from an underside thereof and the shaft 51 is movably inserted into an axial passage 171 of the tube 17. A skirt portion extends from the underside of the knob 50 and the shaft 51 is located at a center in a space enclosed by the skirt portion. A plurality of first teeth 55 are defined in an inner periphery of the skirt portion and engaged with the toothed ring 35 on the reel 30. A plurality of second teeth 54 are defined in the underside of the knob 50 and engaged with the inclined surfaces 22 of the pawls 20. A bolt 57 extends through an underside of the base 11 and is threadedly connected to the shaft 51. A spring 56 is mounted to the shaft 51 and one of two ends of the spring 56 is rested on a head of the bolt 57 so that the knob 50 has a cushion feature by the spring 56 and the two pawls 20 have a cushion feature by the spring 24. When the second teeth 54 move over the inclined surfaces 22 of the two pawls 20, the springs 24 and 56 provide proper cushion feature. The second teeth 54 are shaped such that the knob 50 can only be rotated in one direction and stopped in the other direction by the pawls 20.

Figure 5:
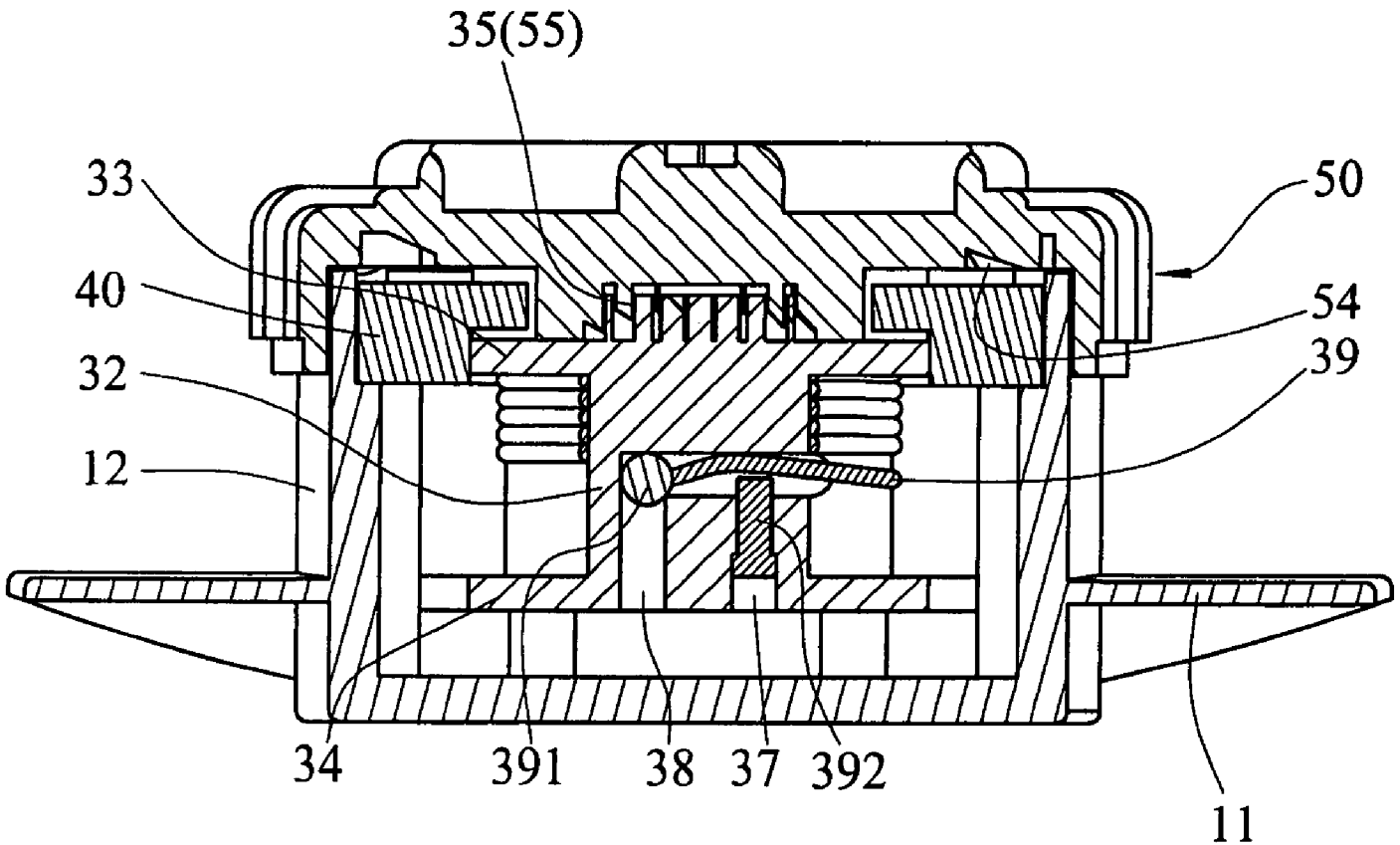
FIG. 5 is a cross sectional view taken along the cutting line C-C in FIG. 2-1.
Figure 6:
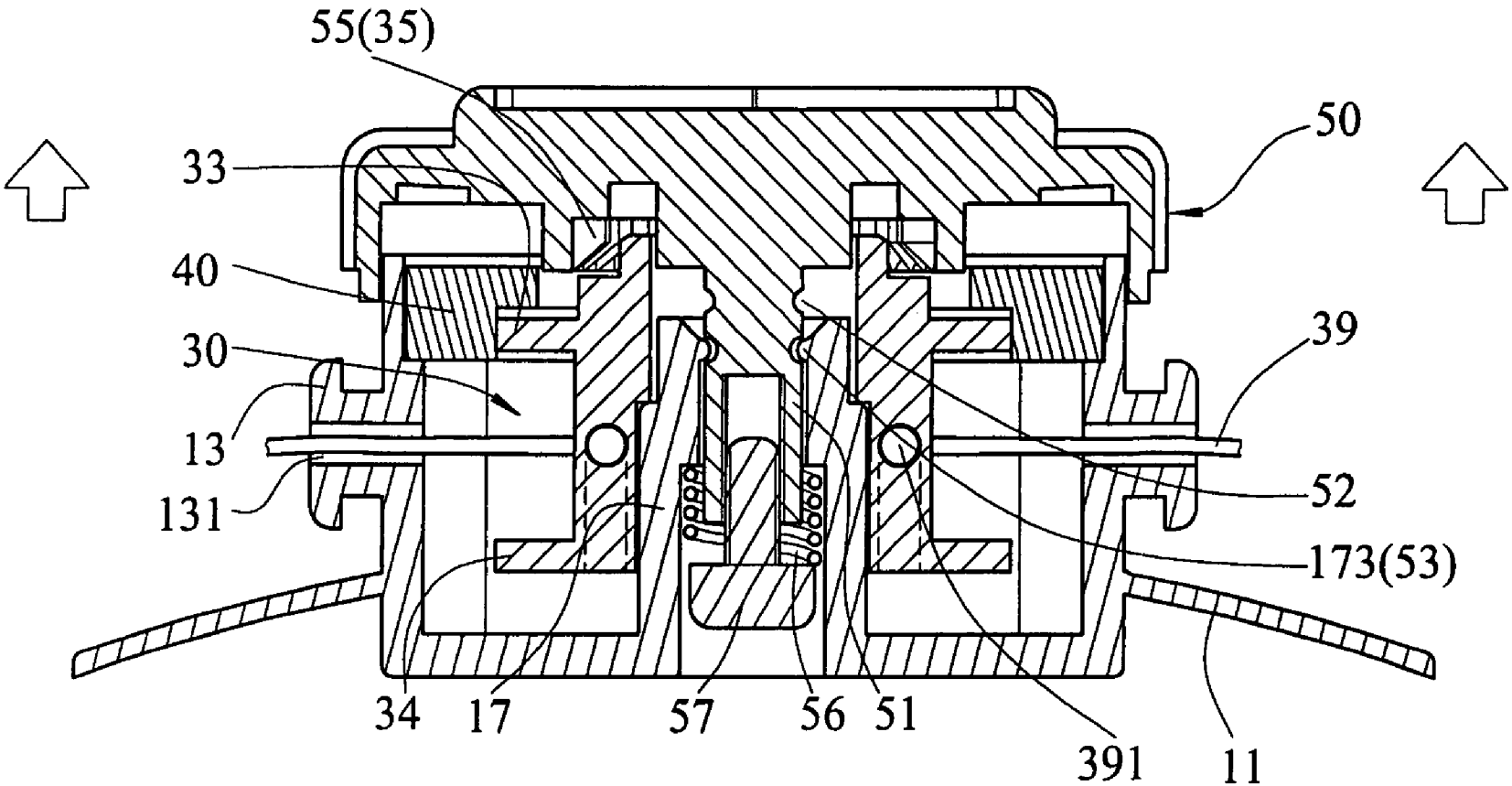
FIG. 6 is a cross sectional view to show that the first teeth are disengaged from the toothed ring on the reel when the knob is pulled upward.
Figure 7:
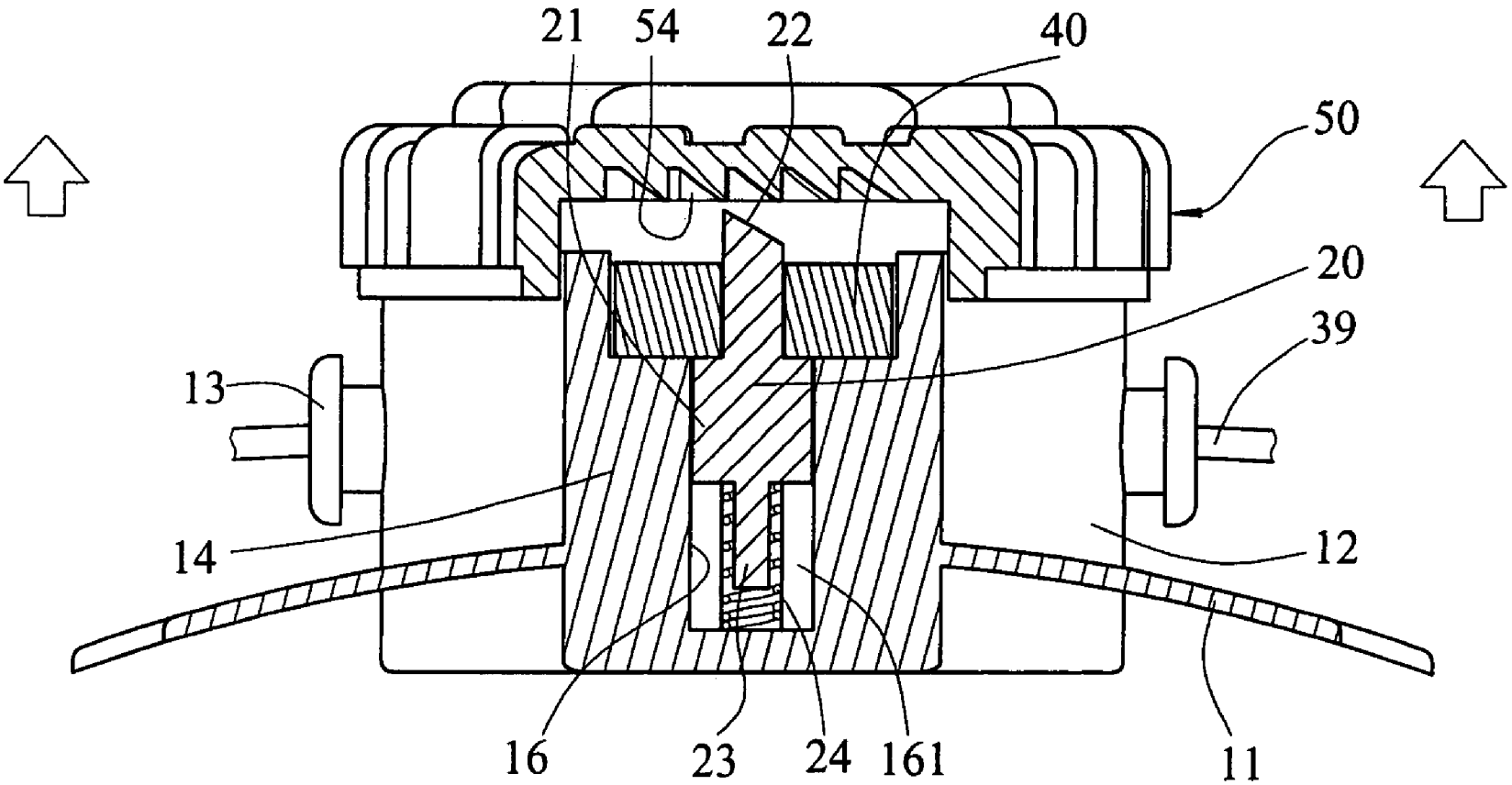
FIG. 7 is a cross sectional view to show that the second teeth are disengaged from the pawls when the knob is pulled upward.
Figure 8:
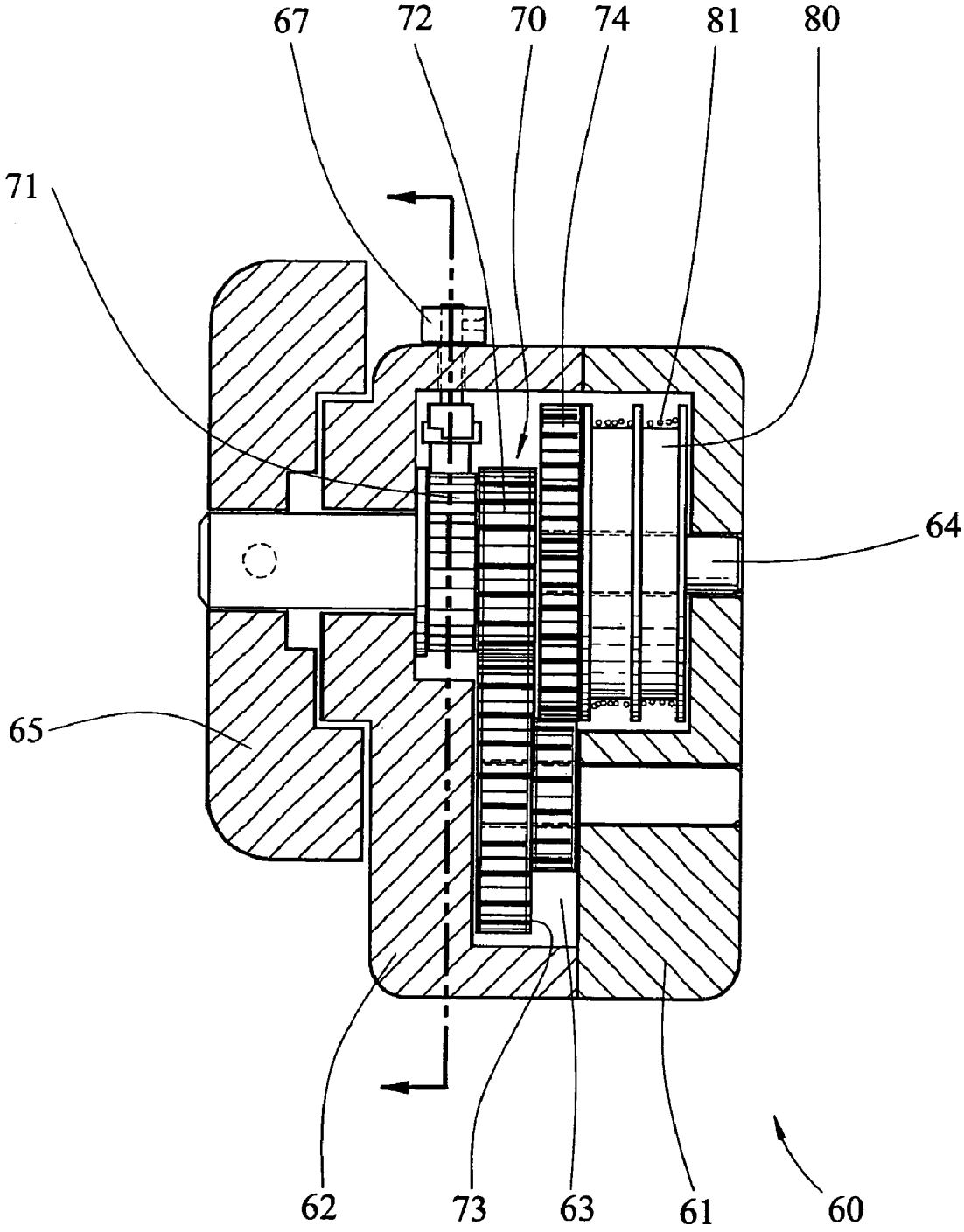
FIG.8 PRIOR ART
FIG. 8 is a cross sectional view to show a conventional string fastening device.
Figure 9:
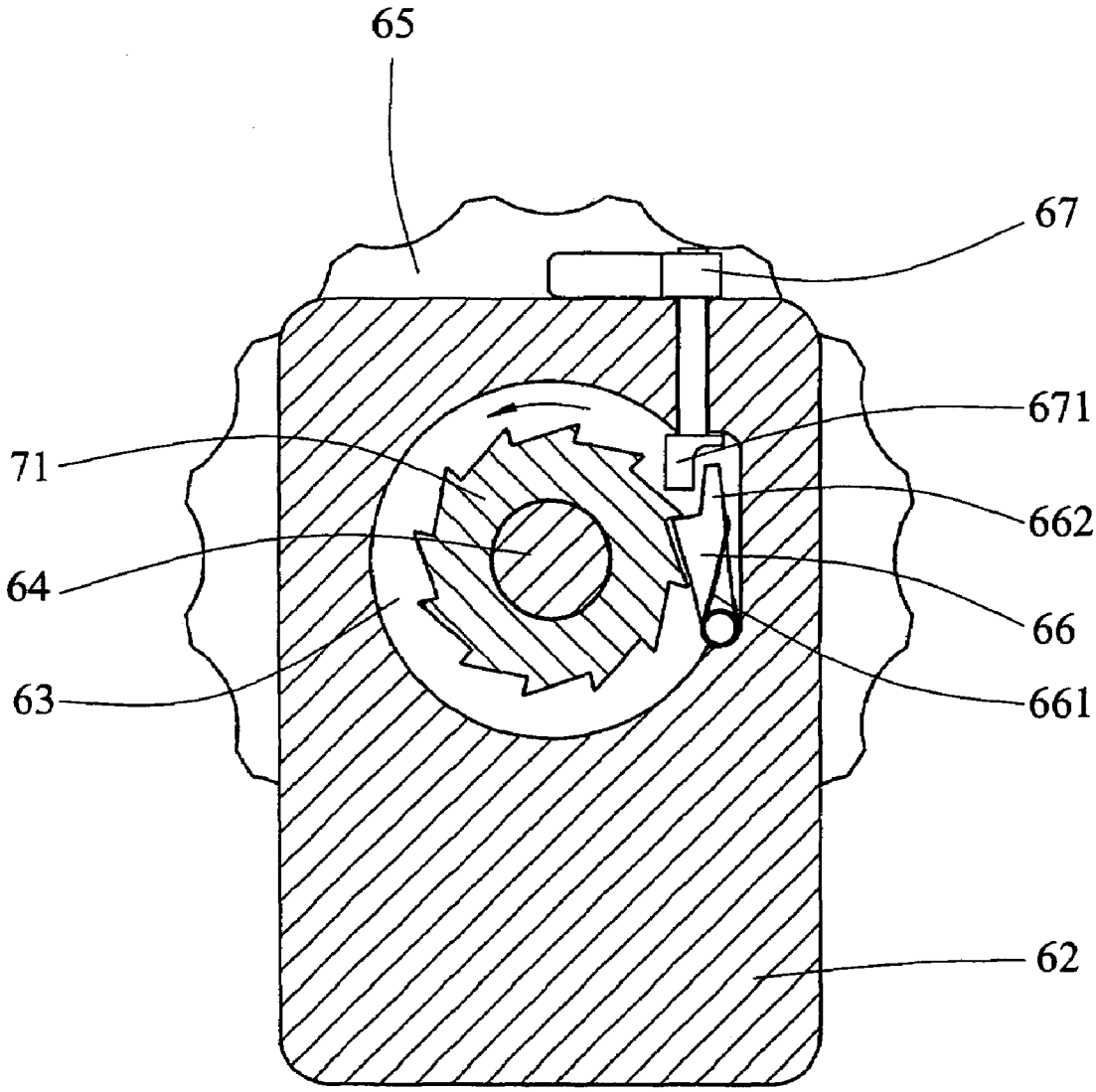
FIG.9 PRIOR ART
FIG. 9 shows the ratchet wheel, the pawl and the shifting lever of the conventional string fastening device.

Referring to FIGS. 5 to 7, when rotating the knob 50 in one direction, the first teeth 55 drives the toothed ring 35 so that the reel 30 is rotated to pull the string 39 to reel on the reel 30. In the meanwhile, the second teeth 54 moves over the inclined surfaces 22 of the two pawls 20 which do not stop the rotation of the knob 50. When the user pull the knob 50 upward, it is noted that the shaft 51 includes two positioning grooves 52, 53 defined in an outer periphery thereof and the tube 17 has a protrusion 173 extends inward from an inner periphery thereof, so that the protrusion 173 is engaged with one of the two positioning grooves 52, 53 in upper and lower positions. When the knob 50 is pulled upward and positioned by engaging the protrusion 173 from one positioning groove 52 to the other positioning groove 53, the second teeth 54 are disengaged from the pawls 20 and the first teeth 55 are disengaged from the toothed ring 35, so that the reel 30 is not driven by the rotation of the knob 50. The user may loosen the string 39 manually.

The fastening device of the present invention does not need a heavy and complicated gear set and there are no protrusion such as the shifting lever exposed on outside of the device. The operation of the knob 50 is easy and the knob 50 can be well positioned by the engagement between the protrusion 173 of the tube 17 and the positioning grooves 52, 53.

While we have shown and described the embodiment in accordance with the present invention, it should be clear to those skilled in the art that further embodiments may be made without departing from the scope of the present invention.

What is claimed is:

1. A string fastening device comprising:

a base with a tubular wall and two holes defined through the tubular wall, a tube extending from a top of the base and located in a space enclosed by the tubular wall, a connection flange extending inward from an inner periphery of the tubular wall and two pawls axially movably inserted into two receiving holes defined in a top of the connection flange, each pawl having an inclined top surface;

a reel having a central hole through which the tube extends and the reel having a toothed ring connected on a top of the reel;

a positioning ring fixedly connected on the connection flange to limit the reel to move in axial direction, two notches defined in an outer periphery of the positioning ring and the two pawls extending through the notches;

a knob having a shaft extending from an underside thereof and the shaft movably inserted into an axial passage of the tube, a skirt portion extending from the underside of the knob and the shaft located at a center in a space enclosed by the skirt portion, a plurality of first teeth defined in an inner periphery of the skirt portion and engaged with the toothed ring on the reel, a plurality of second teeth defined in the underside of the knob and engaged with the inclined surfaces of the pawls such that the knob is rotated in one direction and stopped in the other direction by the pawls, the second teeth being disengaged from the pawls when the knob is pulled upward, and a string having two ends extending through the two holes in the tubular wall and secured to the reel, the string reeled on the reel.

2. The device as claimed in claim 1, wherein the shaft includes two positioning grooves defined in an outer periphery thereof and the tube has a protrusion extending inward from an inner periphery thereof, the protrusion is engaged with one of the two positioning grooves.

3. The device as claimed in claim 2, wherein the tube includes two slots which open to a top of the tube so as to form two parts on the top of the tube, the two parts are expandable outward and inward.

4. The device as claimed in claim 1, wherein the reel includes a tubular body and a first flange extends from a first end of the tubular body and a second flange extends from a second end of the tubular body, the string reeled on the tubular body which includes two apertures defined through a wall of the tubular body, two first passages and two second passages defined axially from an underside of the second flange and perpendicularly communicate with the two apertures respectively, the two ends of the string have two beads connected thereto and each of the two beads extends through one of the apertures and is engaged with one of the second passages, two bolts threadedly connected to the first passages and contact against the strings.

5. The device as claimed in claim 4, wherein the positioning ring has an annular recess defined in an underside thereof and the first flange of the reel is engaged with the annular recess so as to limit the reel to move in the axial direction.

6. The device as claimed in claim 1, wherein a bolt extends through an underside of the base and is threadedly connected to the shaft, a spring is mounted to the shaft and one of two ends of the spring is rested on a head of the bolt.

7. The device as claimed in claim 1, wherein each of the pawls has two wings extending in two opposite direction from an outer periphery thereof and the two receiving holes in the top of the connection flange each have two slits which are in communication with the receiving hole corresponding thereto, the two wings of each pawl are movably inserted into the slits.

8. The device as claimed in claim 1, wherein the positioning ring has a plurality of holes defined therethrough and the connection flange includes a plurality of threaded holes, bolts extend through the holes in the positioning ring and are threadedly connected to the threaded holes to fix the positioning ring on the connection flange.

* * * * *